US010317048B2

(12) United States Patent
Hutchens et al.

(10) Patent No.: US 10,317,048 B2
(45) Date of Patent: Jun. 11, 2019

(54) POCKET LIGHT

(71) Applicant: COAST CUTLERY CO., Portland, OR (US)

(72) Inventors: Douglas R. Hutchens, Lake Oswego, OR (US); Stephen E. Hubert, Portland, OR (US); David D. Lewin, Portland, OR (US); Song Yangzhi, Cixi (CN)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 15/588,582

(22) Filed: May 5, 2017

(65) Prior Publication Data

US 2018/0320864 A1 Nov. 8, 2018

(51) Int. Cl.

| | |
|---|---|
| ***F21V 17/02*** | (2006.01) |
| ***F21V 23/00*** | (2015.01) |
| ***F21L 4/00*** | (2006.01) |
| ***F21V 21/088*** | (2006.01) |
| ***F21V 9/16*** | (2006.01) |
| ***F21V 23/04*** | (2006.01) |
| ***F21V 5/04*** | (2006.01) |
| ***F21V 9/30*** | (2018.01) |
| *F21Y 115/10* | (2016.01) |

(52) U.S. Cl.

CPC ..... *F21V 17/02* (2013.01); *F21L 4/00* (2013.01); *F21V 5/04* (2013.01); *F21V 9/30* (2018.02); *F21V 21/0885* (2013.01); *F21V 23/001* (2013.01); *F21V 23/0414* (2013.01); *F21Y 2115/10* (2016.08)

(58) Field of Classification Search

CPC ..... F21L 4/08; F21V 29/89; F21V 29/773; F21V 21/406; F21V 21/145; F21V 23/0414; F21V 31/00; F21K 9/64; F21Y 2115/10

See application file for complete search history.

(56) References Cited

U.S. PATENT DOCUMENTS

| | | | | |
|---|---|---|---|---|
| 5,410,457 | A * | 4/1995 | Parker | F21L 4/04 362/197 |
| 6,880,951 | B2 * | 4/2005 | Yoon | F21L 4/027 362/202 |
| 7,021,783 | B2 | 4/2006 | Quittner | |
| 7,188,969 | B2 * | 3/2007 | Uke | F21L 4/04 362/197 |
| 7,306,348 | B2 | 12/2007 | Quittner | |
| 7,497,584 | B1 | 3/2009 | Quittner | |
| 7,862,193 | B1 | 1/2011 | Quittner | |
| 7,984,998 | B1 | 7/2011 | Quittner | |
| 8,282,233 | B2 | 10/2012 | Quittner | |

(Continued)

OTHER PUBLICATIONS pelican.com; Pelican VB3 light; https://web.archive.org/web/20040605003951fw_/http://www.pelican.com:80/new_products/trade.html; Mar. 23, 2004.

*Primary Examiner* — Tracie Y Green

(74) *Attorney, Agent, or Firm* — Schwabe Williamson & Wyatt, P.C.

(57) ABSTRACT

A light having a body defining a battery casing for storing one or more batteries, a head rotatably mounted to the body, the head and the body including complementing, contacting, rounded portions, the head further including a light display and an LED light source, the LED light source being electrically connected to the battery casing for providing electrical power to the LED light source when batteries are disposed in the battery casing.

11 Claims, 10 Drawing Sheets

(56) References Cited

U.S. PATENT DOCUMENTS

| | | | | |
|---|---|---|---|---|
| 8,348,454 | B2 * | 1/2013 | Henry | F21V 21/406 362/196 |
| 8,710,721 | B1 * | 4/2014 | Li | F21K 9/64 313/35 |
| 8,777,446 | B2 * | 7/2014 | Sharrah | F21L 4/027 362/197 |
| 8,851,697 | B2 | 10/2014 | Quittner | |
| 9,638,379 | B2 * | 5/2017 | Sun | F21L 4/04 |
| D824,063 | S * | 7/2018 | Hutchens | D26/60 |
| 2011/0121727 | A1 * | 5/2011 | Sharrah | F21L 4/00 315/32 |
| 2012/0147588 | A1 * | 6/2012 | Yang | F21K 9/232 362/84 |
| 2013/0095439 | A1 * | 4/2013 | Putrello, Jr. | F23Q 7/02 431/258 |

* cited by examiner

POCKET LIGHT

FIELD OF THE INVENTION

The invention relates generally to a light with a rotatable head.

BACKGROUND

Small lights have been used for many years. Small flashlights have become popular of late due to advances in the design of Light Emitting Diodes (LEDs) and the incorporation of LEDs into small lights of all types. While such lights have proven extremely effective due to their brightness and low battery power requirements, light design seems not to have taken full advantage of the light weight and small size advantages of LED technology. For example, small LED flashlights have been designed to be clipped onto the brim of ball caps. While sometimes clumsy due to their weight, they often do permit one to walk without holding a flashlight, thus freeing the hands for other things. Headlamps designed to be strapped to the head have proven even more effective in permitting the wearer to perform a variety of tasks. LED technology has also been incorporated into reading lamps, again providing brightness in a small package.

While such lights have taken advantage of lightweight LED technology, they seem to be somewhat limited in their versatility. For example, small LED lights are often designed to be part of a headlamp, a flashlight, a headlamp or reading light. Rarely has a light been designed that can be useful for all of these applications.

DETAILED DESCRIPTION OF THE PREFERRED EMBODIMENT

Figure 3:
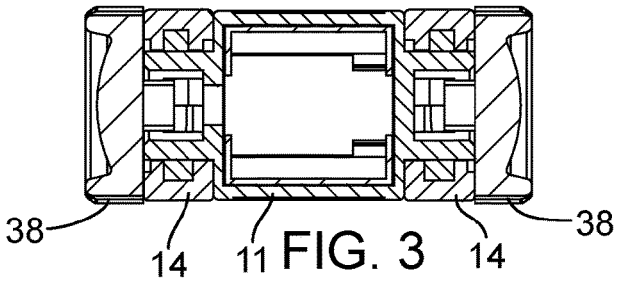
FIG. 3 is an end elevation sectional view taken along line 3-3 of FIG. 1.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

A light having a body defining a battery casing for storing one or more batteries may be provided, also including a head rotatably mounted to the body. The head and the body typically including complementing, contacting, rounded portions, the head further including a light display and an LED light source. The LED light source is electrically connected to the battery casing for providing electrical power to the LED light source when batteries are disposed in the battery casing.

A pair of wires typically provide the electrical connection between the battery casing and the LED light source, the pair of wires include slack when the head is at a central position, the wires becoming more taut when the head is rotated in one direction or the other.

The light also preferably includes a spring-biased clip mounted to the body to permit the light to be clipped to another object, such as the bill of a cap, an article of clothing or the like.

The light may also include a switch to turn the light on and off, and a flexible plate disposed over the switch and mounted to the body such that be depressing the flexible plate the switch is turned on and off.

Another way to define this embodiment as a light having a body defining a battery casing for storing one or more batteries, a generally cylindrical head rotatably mounted to a complementing rounded portion of the body, the head further including a light display and a light source, the light source being electrically connected to the battery casing for providing electrical power to the light source when batteries are disposed in the battery casing.

The depicted embodiment provides a light that is compact, lightweight, and takes full advantage of LED technology in providing a bright light that still has the capability of permitting long battery life. Most importantly, the head of the light provides a capability of being rotated so that the user can take full advantage of the light, whether it be positioned on the bill of a ball cap, attached to the pocket of a shirt, or worn as part of a headlamp.

Figure 1:
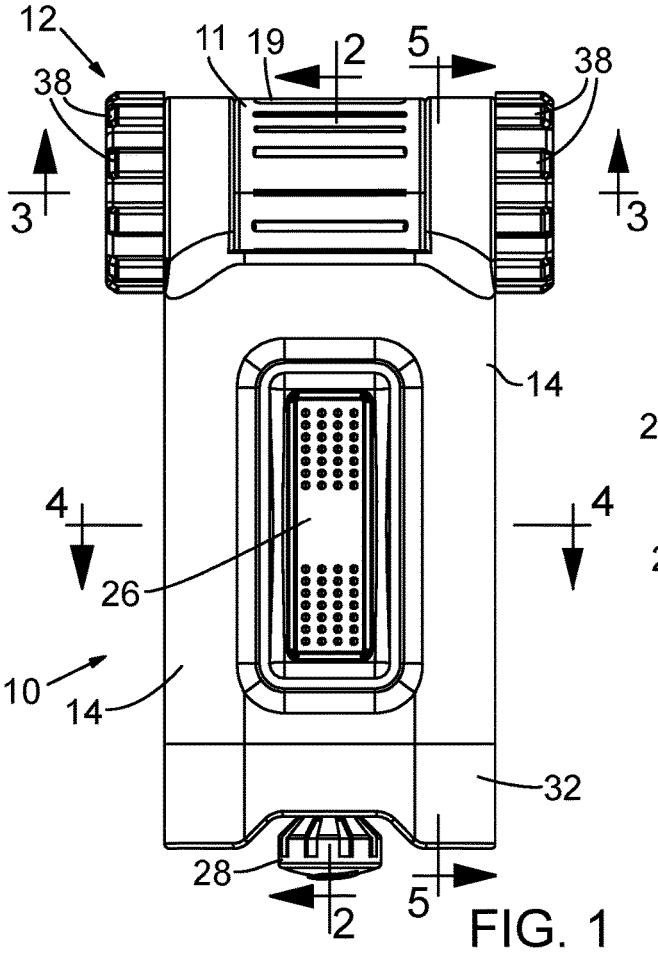
FIG. 1 is a front elevation view of an embodiment of the present disclosure.
Figure 2:
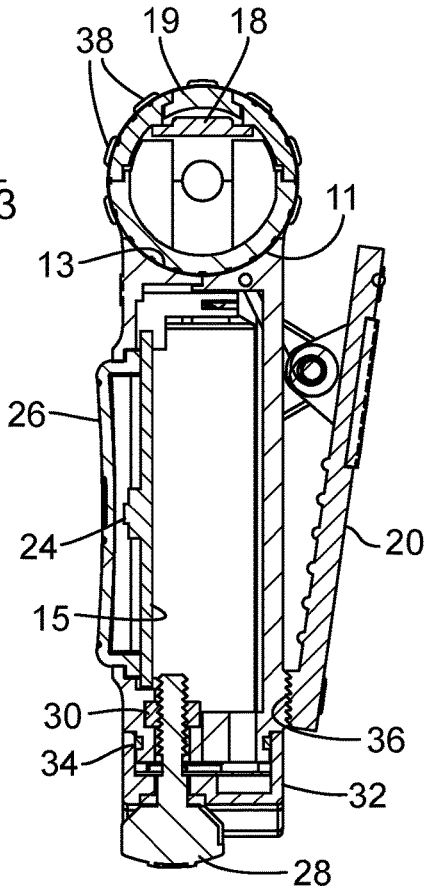
FIG. 2 is a side elevation sectional view taken along line 2-2 of FIG. 1.
Figure 4:
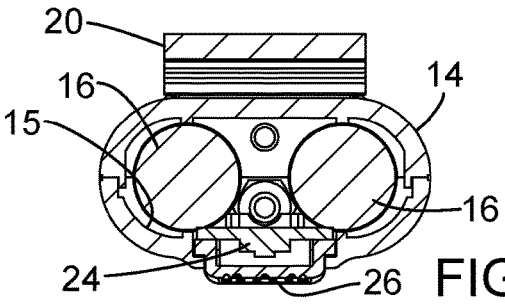
FIG. 4 is an end elevation sectional view taken along line 4-4 of FIG. 1.
Figure 5:
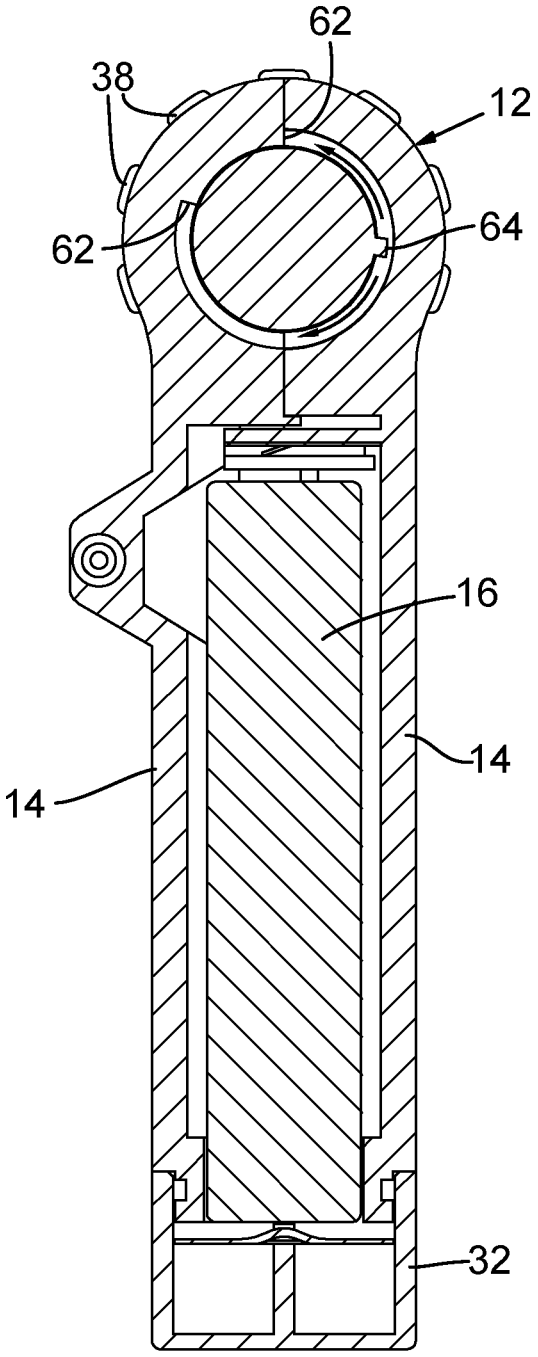
FIG. 5 is a side elevation sectional view taken along line 5-5 of FIG. 1.
Figure 6:
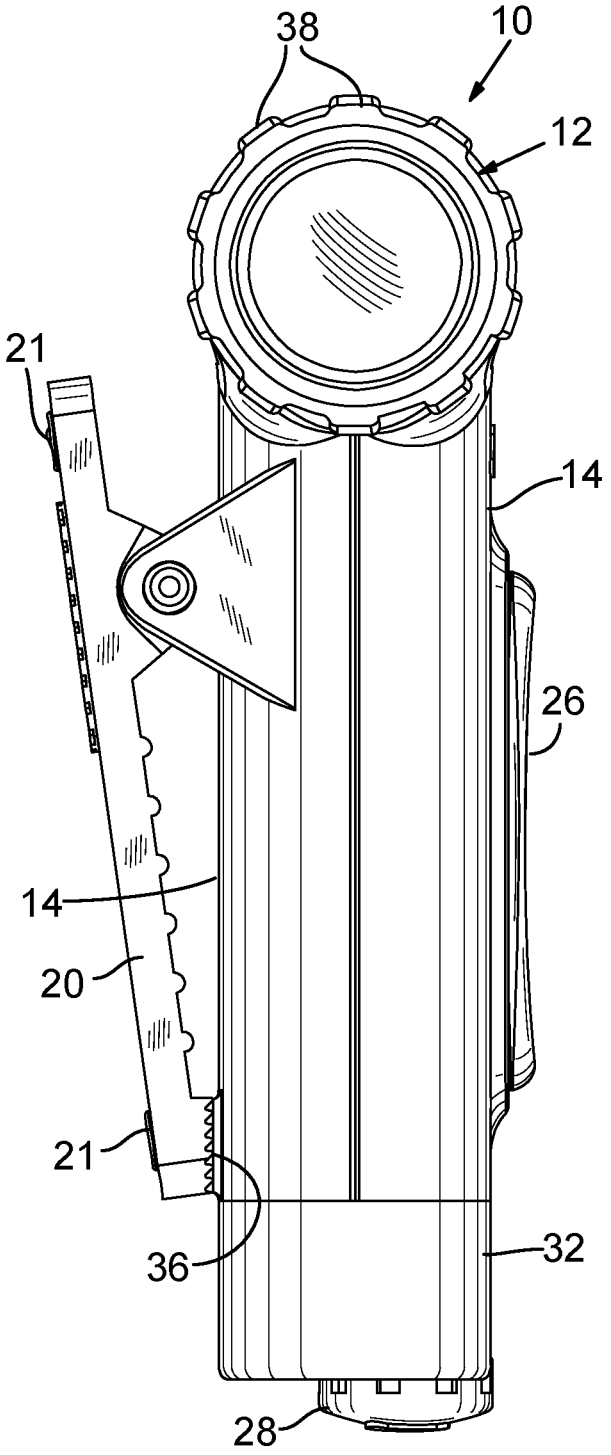
FIG. 6 is a side elevation view of the embodiment of FIG. 1.
Figure 7:
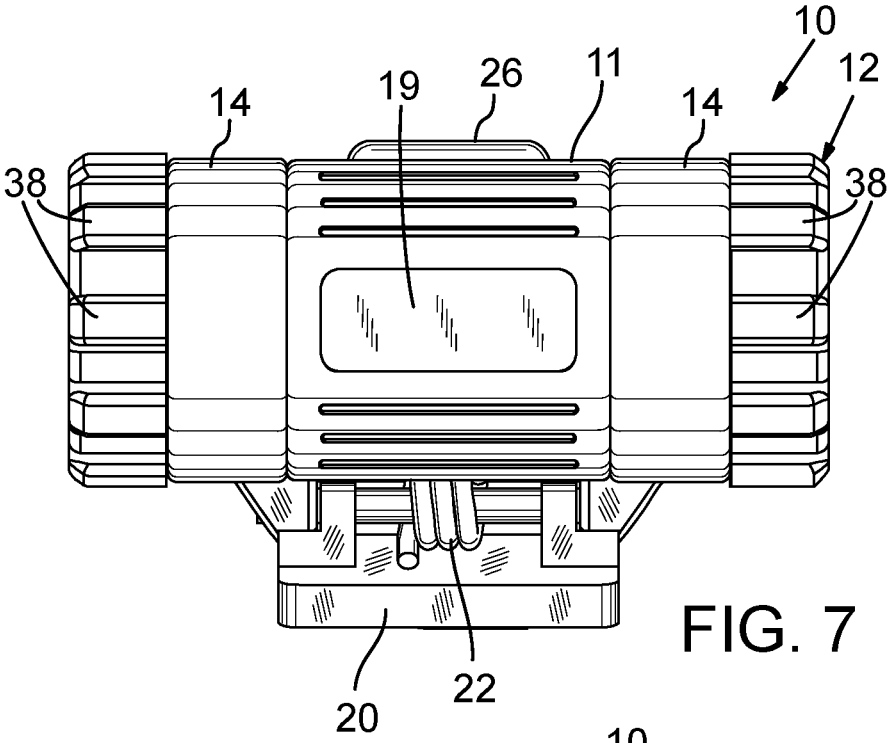
FIG. 7 is an end elevation view from the front of the embodiment of FIG. 1.
Figure 8:
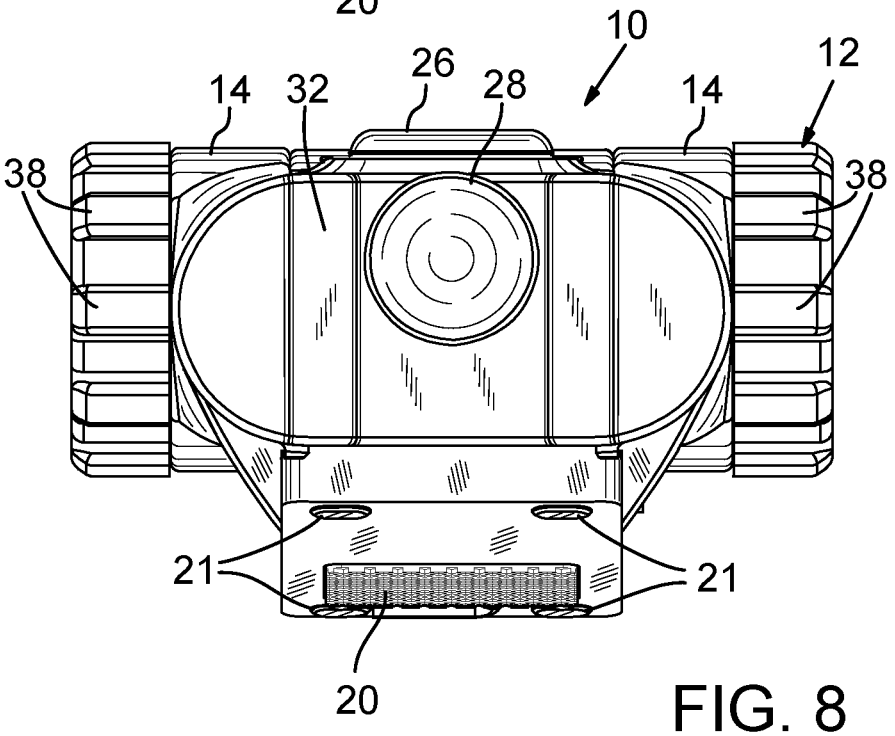
FIG. 8 is an end elevation view from the rear of the embodiment of FIG. 1.

FIGS. 1 and 2 provide perhaps the best overall view of the depicted embodiment, identified generally with the numeral 10. This embodiment of light 10 may include a head 12, which is rotatably mounted to a body 14 that includes an internal casing designed to hold one or more batteries 16 to provide power for an LED lighting system 18 provided in the head. The LED shines through a lens 19 disposed at the front or on the top of head 12. The term "rotatable" or "rotatably mounted" means that head 12 may be rotated at least part of a complete circle. As will be better appreciated as this discussion continues, that rotation might constitute 180 degrees of rotation or might be much less or even more than that. This rotation is provided so that the user is able to direct light from the LED 18 through lens 19 to shine in different directions. This might be for purposes of reading when light 10 is fastened to the bill of a cap or to a shirt pocket, or might be to permit the user to adjust quickly to lighting the ground at the user's feet or at the terrain ahead.

While the depicted head 12 is cylindrical, it should be understood that it is only necessary that a portion of the head be rounded such as at 11, such that it complements a rounding 13 of the forward end of body 14. That complementing rounding only needs to extend to the same extent that the head is designed to rotate. So, for example if the head is designed to rotate 45 degrees (22.5 degrees in either direction), there only needs to be complementing rounding for 22.5 degrees.

Continuing with the exterior features, light 10 may include a clip 20, biased toward a closed position by spring 22. Clip 20 may take just about any configuration as long as it is designed for a variety of uses, for example, to clip the light to another object such as a hat, headset, shirt pocket, coat sleeve, bike helmet, binoculars, etc. An on/off switch 24 may be provided in the side of body 14 opposite clip 20, although most any conventional positioning would suffice as long as it is easy to find and activate with little fumbling. In the depicted embodiment, switch 24 is actually disposed under a flexible exterior plate 26, which may be depressed to activate the switch. One advantage of the depicted construction is that plate 26 is enlarged so the light may be turned on and off by a user wearing gloves or mittens.

Figure 9:
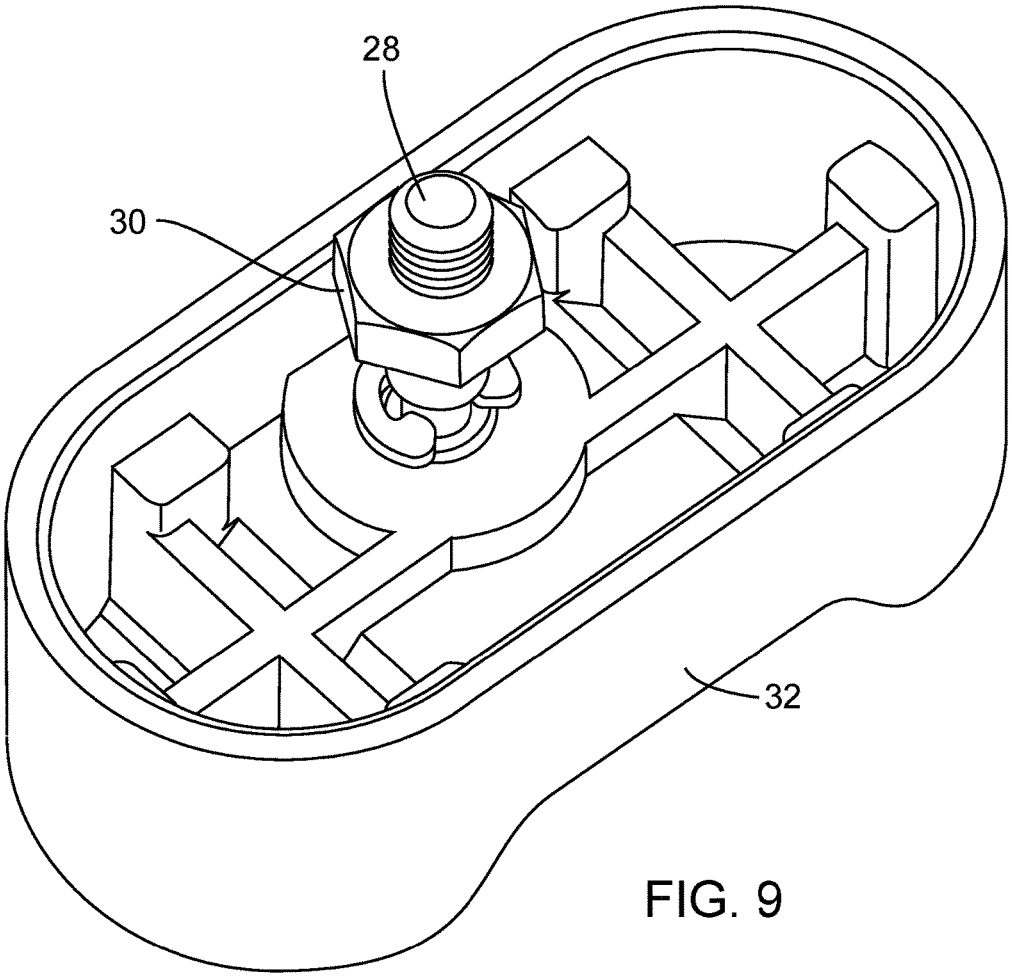
FIG. 9 is a perspective view of the inside of a rear cap that may be used with the embodiment of FIG. 1.

The rear of the depicted light 10 is provided with a rotatable knob 28, the functioning of which is best shown in FIGS. 2 and 9. Knob 28 may be mounted to an internal nut (see FIG. 9), which engages an interior shoulder 30 to pull a rear cap 32 against the rear of body 14 to create what preferably is a watertight seal. An O-ring 34 may be provided if desirable. Because light 10 is designed for a wide variety of uses, any one of which might be in the rain or might involve other momentary dousing with water, this may be a desirable feature. Knob 28 may be unscrewed to release rear cap 32 and permit replacement of battery or batteries 16. Knob 28 may be enlarged and have ridges around its circumference so that it too may be turned with minimal difficulty by a user wearing gloves or mittens.

Knurled or ridged surfaces may be provided on the distal end of clip 20 as shown at 36 to facilitate a secure engagement with the material or object to which the light is clipped. Such surfaces may also be provided in head 12, although the depicted embodiment includes a plurality of ridges 38. Either will be suitable to provide an engagement surface to permit grasping and rotation of the head. In the depicted embodiment, ridges 38 are provided only on the ends of head 12.

The electrical circuitry for light 10 is shown generally at 40, but it may be of conventional design using appropriate resistors, capacitors, relays, diodes, inductors, grounds and the like. A chip on board (COB) system may be used as an LED system 18 to provide light to shine through lens 19, such a system comprising multiple LED chips bonded to a substrate to form a single module. The multiple LEDs are preferably shielded with a phosphorous cover to diffuse the light so the light appears as a single spotlight or floodlight through the display.

Figure 10:
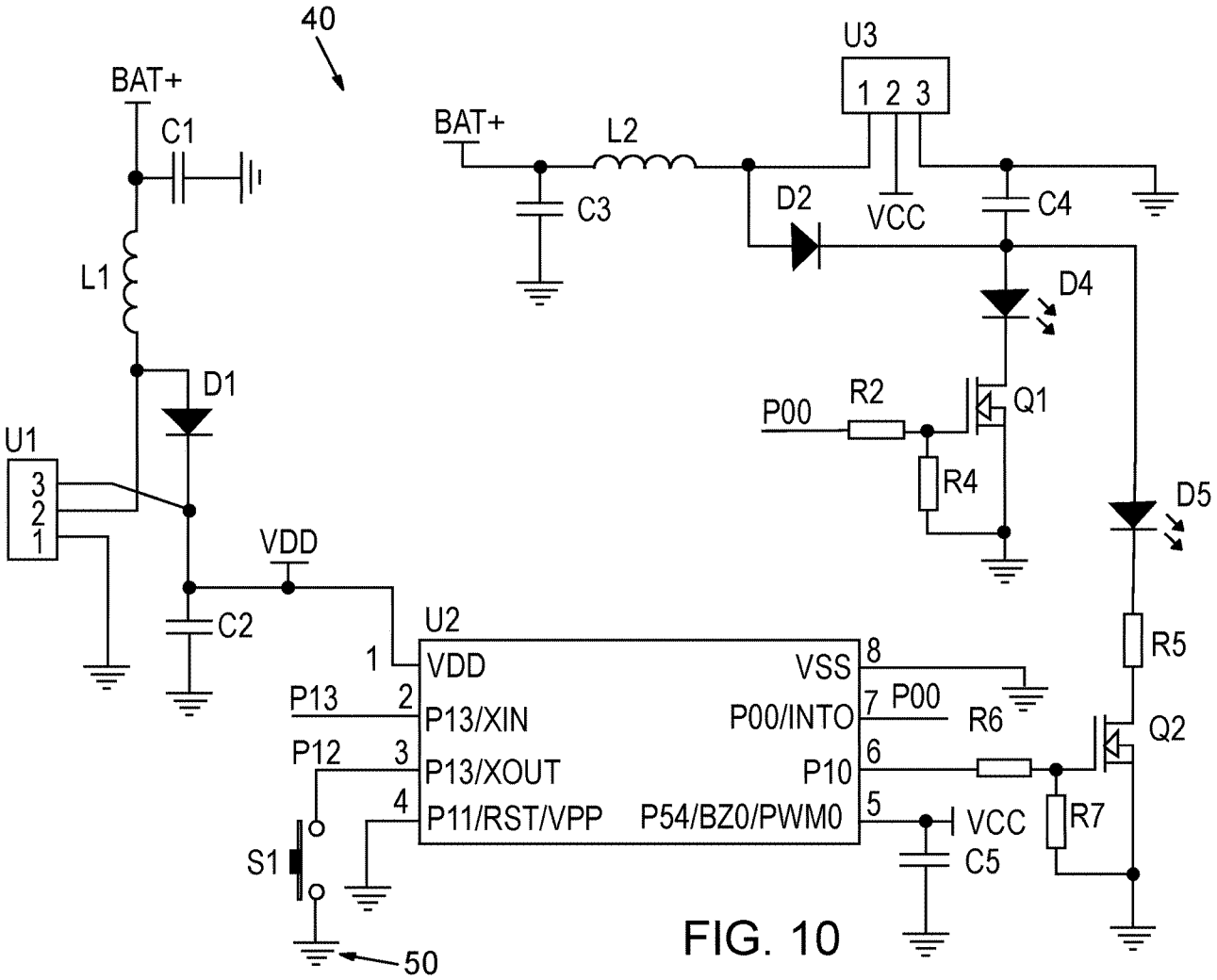
FIG. 10 is a circuit diagram of a circuit that may be used with the embodiment of FIG. 1.

FIG. 10 illustrates an example of electrical circuitry 40 that may be implemented within light 10. The circuitry may include a light-emitting diode (LED) D4 and a LED D5. The LED D4 and the LED D5 may be located within the COB system 18 (see FIG. 2). The LED D4 and the LED D5 may be different color LEDs, may produce different wavelengths of light, may be associated with different colored lenses to produce different colors of light, or some combination thereof. In some examples, the LED D4 may be a white LED and the LED D5 may be a red LED. In other examples, the LED D4 may be a white LED and the LED D5 may be an ultraviolet LED. While the LED D4 and the LED D5 are described as single LEDs throughout the description of FIG. 10, it is to be understood that the LED D4 may be a first array of multiple LEDs having the same characteristics and/or the LED D5 may be a second array of multiple LEDs having the same characteristics. Further, the characteristics of the first array may be different from the characteristics of the second array.

The electrical circuitry 40 may further include a processor U2. The processor U2 may include a pin P13/XOUT coupled to switch S1. The processor U2 may detect activation of the switch S1. The activation of the switch S1 in the illustrated example includes a first state of the switch S1 that couples the pin P13/XOUT to ground 50, whereas deactivation of the switch S1 occurs when the switch S1 is in a second state that decouples pin P13/XOUT from the ground 50.

The processor U2 may control outputs of pin P00/INTO and pin P10 based on the activation of the switch S1. The pin P00/INTO may be coupled to transistor Q1 and control activation of the transistor Q1 (i.e. current flow between the source and drain of the transistor Q1). When the transistor Q1 is activated (i.e. current is flowing between the source and drain of transistor Q1) by the output of the pin P00/INTO, current may pass through the LED D4, causing the LED D4 to produce light. When the transistor Q1 is deactivated (i.e. current is not flowing between the source and drain) by the output of the pin P00/INTO, the transistor Q1 may prevent current from passing through the LED D4, causing the LED D4 to not produce light.

The pin P10 of processor U2 may be coupled to transistor Q2 and control activation of the transistor Q2 (i.e. current flow between the source and drain of the transistor Q2). When the transistor Q2 is activated (i.e. current is flowing between the source and drain of transistor Q2) by the output of the pin P10, current may pass through the LED D5, causing the LED D5 to produce light. When the transistor Q2 is deactivated (i.e. current is not flowing between the source and drain) by the output of the pin P10, the transistor Q2 may prevent current from passing through the LED D5, causing the LED D5 to not produce light.

The processor U2 may transition between two or more states based on the detection of activation of the switch S1, where transistor Q1 and transistor Q2 may be activated, deactivated, or some combination thereof, in the different states. In some examples, the processor U2 may transition between three states. In a first state, the processor U2 may deactivate the transistor Q1 and the transistor Q2, causing the LED D4 and the LED D5 to not produce light. In response to detecting an activation of the switch S1 while in the first state, the processor U2 may transition from the first state to a second state, where the U2 activates the transistor Q1 and deactivates the transistor Q2, causing the LED D4 to produce light and the LED D5 not to produce light. In response to detecting an activation of the switch S1 while in the second state, the processor U2 may transition from the second state to a third state, where the processor U2 activates both the transistor Q1 and the transistor Q2, causing the LED D4 and the LED D5 to produce light. In response to detecting an activation of the switch S1 while in the third state, the processor U2 may transition back to the first state with the transistor Q1 and the transistor Q2 deactivated.

Circuitry 40 may further include one or more other circuit elements. The other circuit elements may include capacitor C1, capacitor C2, capacitor C3, capacitor C4, capacitor C5, inductor L1, inductor L2, resistor R2, resistor R4, resistor R5, resistor R6, resistor R7, diode D1, diode D2, or some combination thereof. The other circuit elements may be selected based on the characteristics of the processor U2, the LED D4, the LED D5, the transistor Q1, the transistor Q2, the switch S1, a voltage of a battery coupled to the electrical circuitry 40 (indicated by battery connection BAT+) or some combination thereof.

Figure 11:
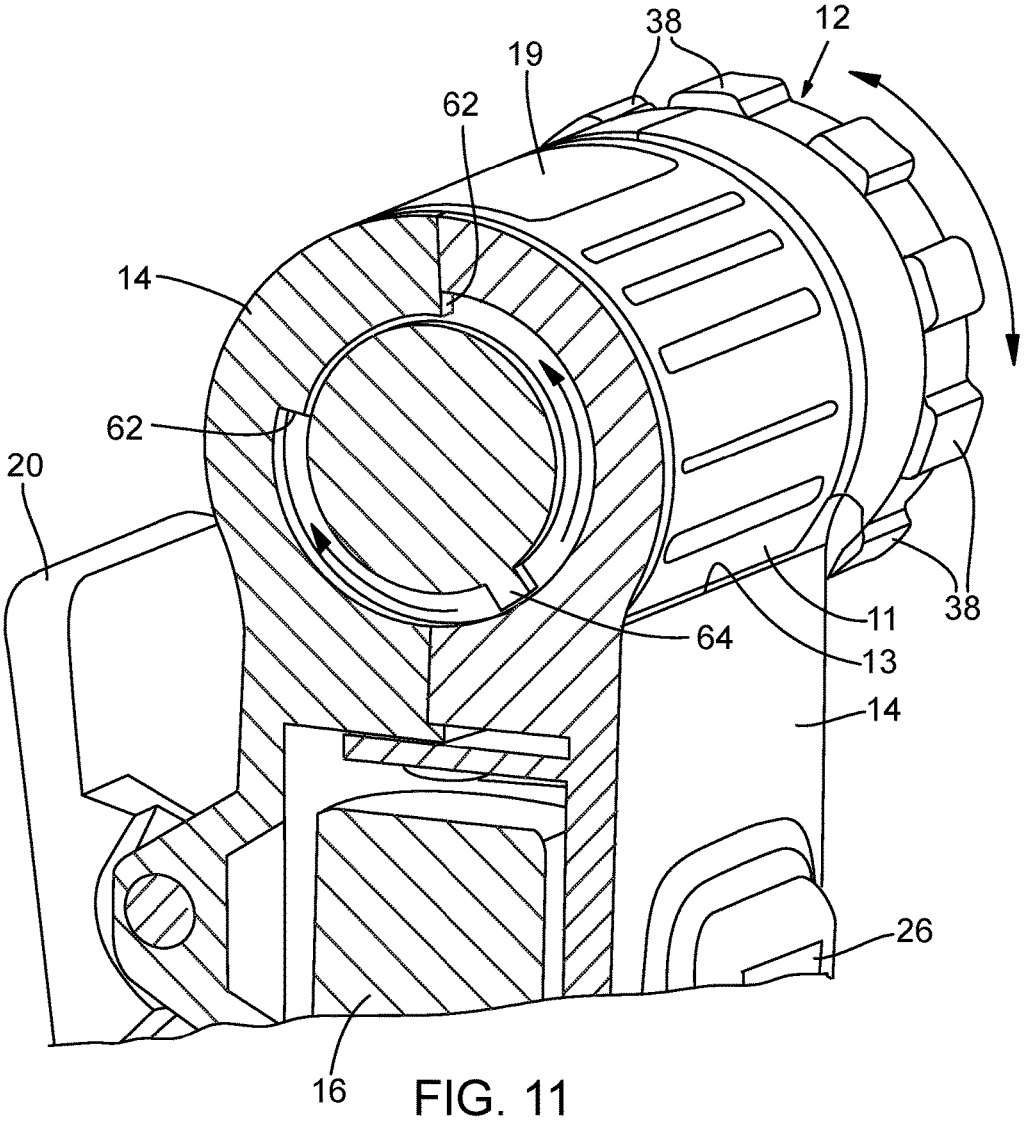
FIG. 11 is a fragmentary cutaway perspective view of the embodiment of FIG. 1 showing the stops and leg that may limit rotation of the head of the embodiment of FIG. 1.
Figure 12:
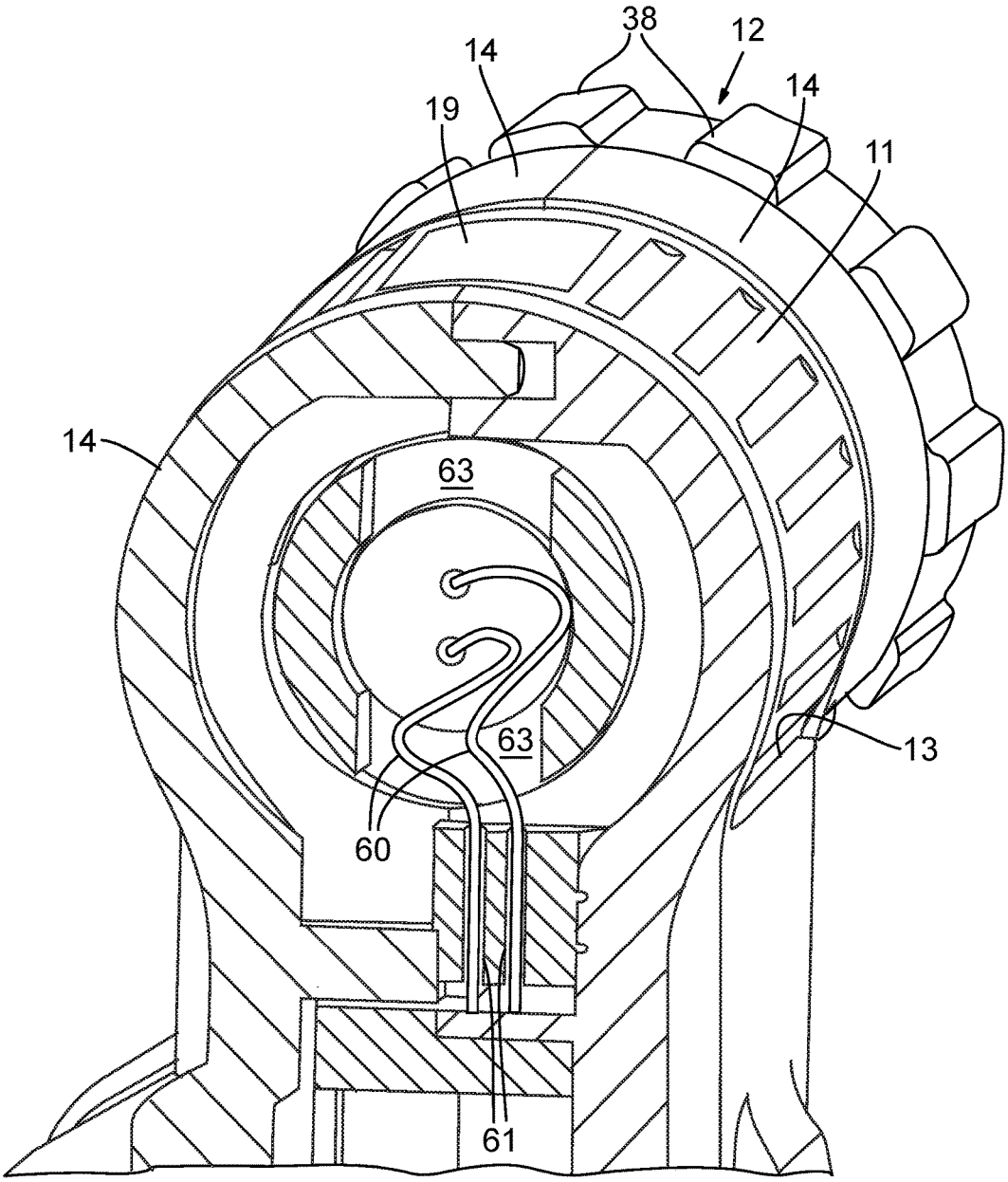
FIG. 12 is a fragmentary cutaway perspective view of the embodiment of FIG. 1 showing the slack in the wires that may be provided when the head of the embodiment of FIG. 1 is in a central position.
Figure 13:
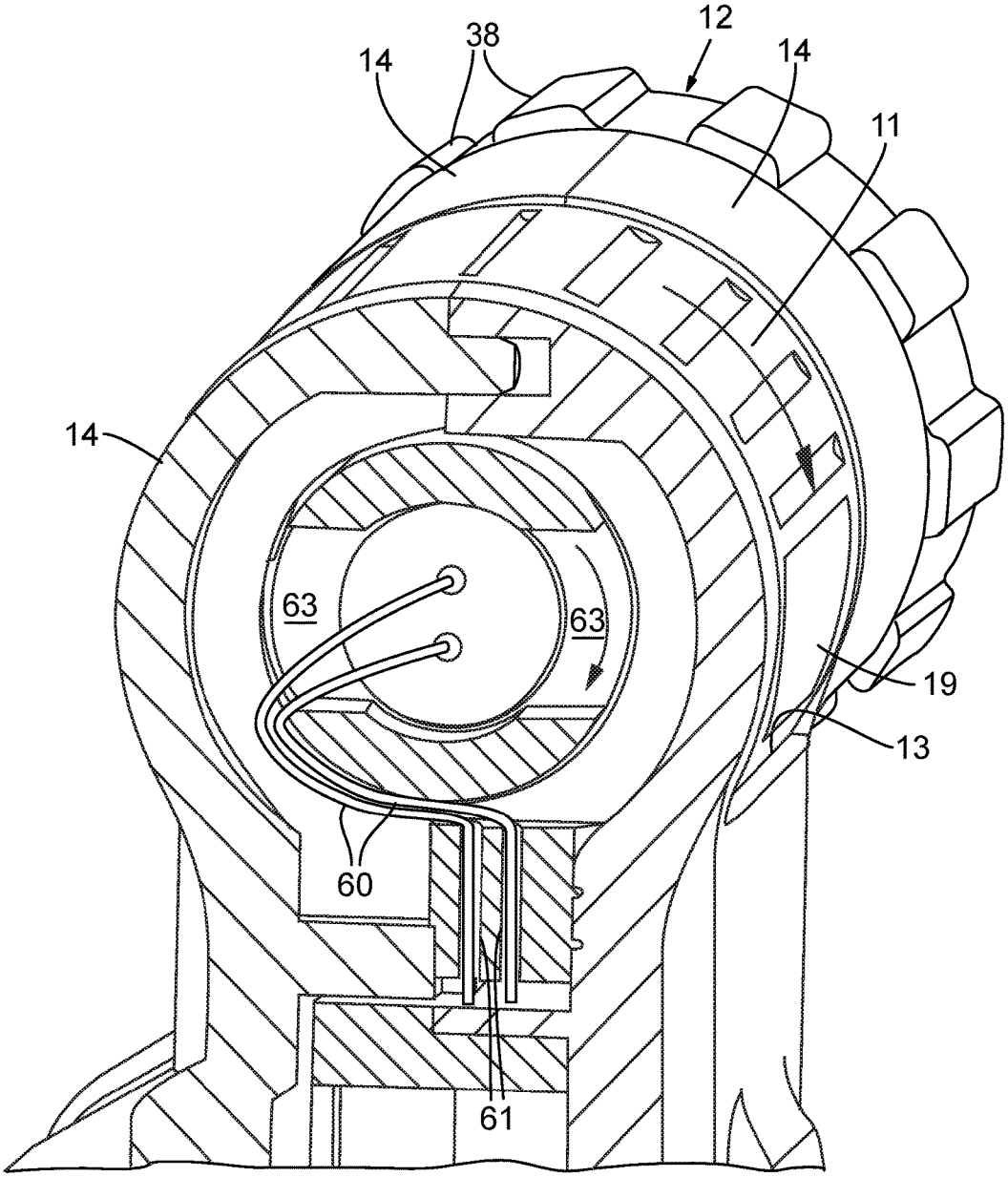
FIG. 13 is a fragmentary cutaway perspective view of the embodiment of FIG. 1 showing the taut wires when the head of the embodiment of FIG. 1 is rotated in a clockwise direction.
Figure 14:
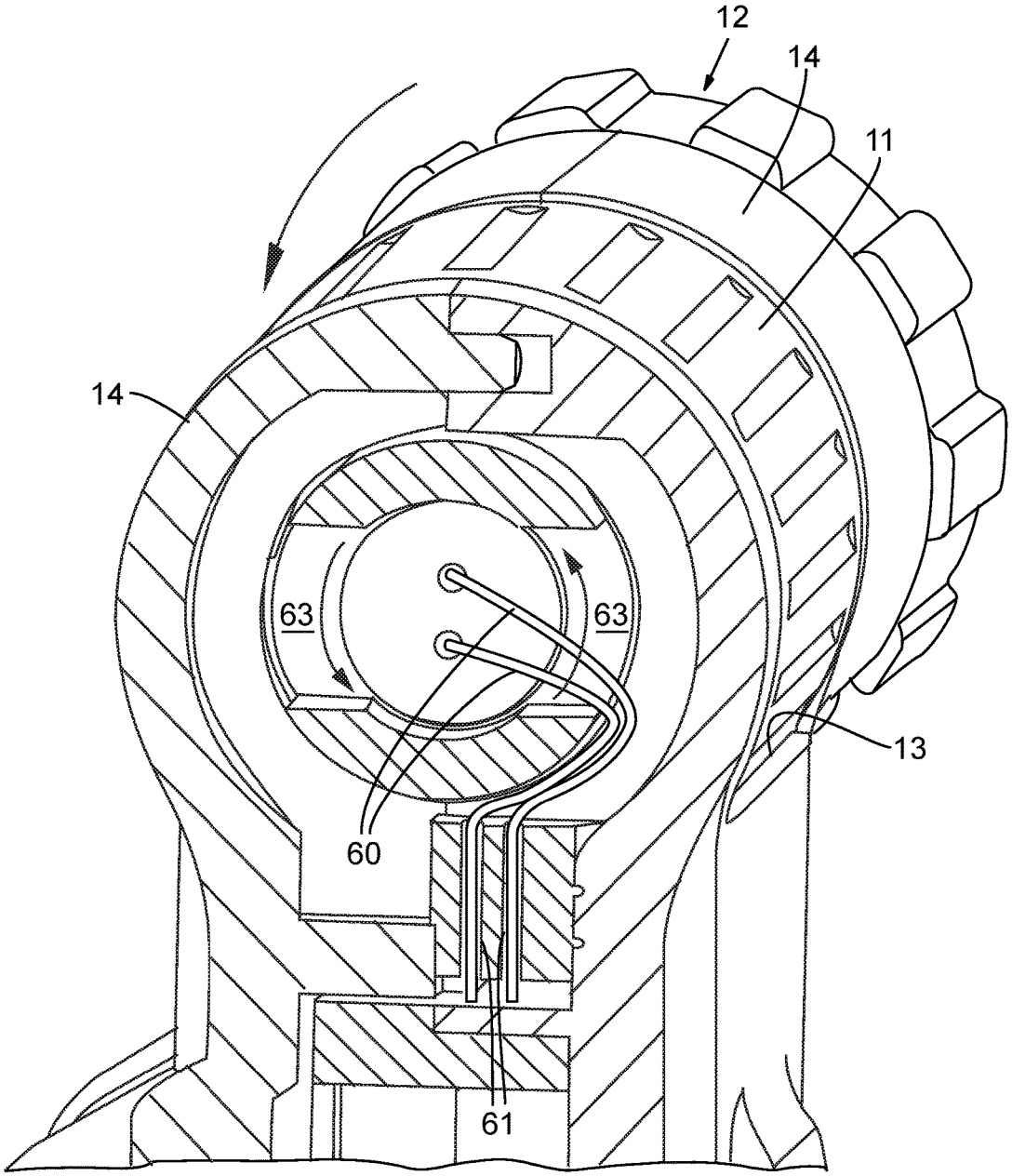
FIG. 14 is a fragmentary cutaway perspective view of the embodiment of FIG. 1 showing the taut wires when the head of the embodiment of FIG. 1 is rotated in a counterclockwise direction.

The preferred embodiment includes two AAA batteries although more or fewer batteries of other size may alternatively be provided. Batteries 16 are mounted in a conventional fashion such that wires 60 extend from battery casing 15 through at least one channel, although a pair of channels 61 are depicted in FIGS. 12-14. Cutouts 63 may be provided through which the wires can extend. FIG. 12 illustrates that wires 60 may include extra slack or length to facilitate rotation of head 12. FIGS. 13 and 14 show the head rotated to one side and then the other in a 180-degree range. However, more or less rotational range may be desirable. Stops such as those shown at 62 may be provided to limit the range of rotation along with a leg 64 that is designed to abut the stops when head 12 is at the full extent of the desired rotation. However, in lieu of stops 62 and leg 64, the extent of rotation may be limited simply by that range being the extent of the complementing rounding 11 of head 12 and the rounding 13 of body 14. In FIG. 11 that range is shown to be 270 degrees, while in FIGS. 13 and 14, that range is shown to be about 180 degrees. As noted earlier, the range of rotation may be more or less than either of those ranges. FIG. 12 shows head 12 in its central position whereas FIG. 13 shows it rotated in a clockwise direction from the perspective of that Fig., while FIG. 14 shows the head rotated in the opposite direction.

Thus described, the depicted embodiment provides a compact, lightweight, bright, and versatile light having a head that can be rotated to a wide variety of positions to give the user, whether it be a reader, hiker, bike rider, bird watcher or other hobbyist, a selection of positions in which to direct the LED system 18 (via lense 19). In certain embodiments light 10 can include clip 20, which provides even greater versatility to the user.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A light comprising:

a body defining a battery casing for storing one or more batteries, the battery casing defining a width dimension extending from side-to-side, a height dimension that is longer than the width dimension and has a top and bottom, and a thickness dimension that is the smallest of the three dimensions, extending from a front to a back of the casing;

a cylindrical head rotatably mounted to the top of the body, the head and the body including complementing, contacting, rounded portions, and an axis of rotation of the cylindrical head extending from side-to-side and being parallel with the width dimension of the battery casing; and an LED light source disposed in the cylindrical head, the LED light source being electrically connected to the battery casing for providing electrical power to the LED light source when batteries are disposed in the battery casing.

2. The light of claim 1 wherein the cylindrical head extends from side-to-side beyond the width dimension of the battery casing to permit the user to roll either side of the cylindrical head with respect to the battery casing.

3. The light of claim 1 wherein the cylindrical head has two ends and each of the two ends extends from side-to-side beyond the width dimension of the battery casing to permit the user to roll either side of the cylindrical head with respect to the battery casing.

4. The light of claim 1, further comprising a spring-biased clip mounted to the front or back of the body to permit the light to be clipped to another object.

5. The light of claim 1 further comprising a phosphorous cover disposed over the LED light source to diffuse the light being emitted from the LED.

6. The light of claim 4, further comprising a switch to turn the light on and off, and a flexible plate disposed over the switch and mounted to the front or back of the body, opposite of the clip, such that by depressing the flexible plate, the switch is turned on and off.

7. The light of claim 1 wherein the light source is flush with the exterior of the cylindrical head.

8. The light of claim 1 wherein the light source comprises an LED with a lens covering the LED, and the lens is flush with the exterior of the generally cylindrical head.

9. The light of claim 1 wherein the light is sized such that when the light is disposed in a shirt pocket of a user, the cylindrical head is exposed above the shirt pocket but the battery casing is not.

10. The light of claim 1 wherein the cylindrical head defines a diameter that is substantially the same as the thickness dimension.

11. The light of claim 1 wherein the cylindrical head is centered over the body so the light is unlikely to tilt forward when placed in a shirt pocket of a user.

* * * * *